United States Patent [19]

Ehrenpreis et al.

[11] 4,226,250

[45] Oct. 7, 1980

[54] SMOKING SYSTEM TO FILTER TOBACCO SMOKE

[75] Inventors: Seymour Ehrenpreis; Barry Freedman, both of Skokie, Ill.

[73] Assignee: Peterson Labs., Inc., Chicago, Ill.

[21] Appl. No.: 923,980

[22] Filed: Jul. 12, 1978

[51] Int. Cl.[2] ..... A24F 13/02; A24F 7/04

[52] U.S. Cl. ..... 131/187; 131/10.7; 131/202

[58] Field of Search ..... 131/187, 262 R, 262 A, 131/266, 202, 10.7, 10 R, 10.1

[56] References Cited

U.S. PATENT DOCUMENTS

| | | | |
|---|---|---|---|
| 2,754,829 | 7/1956 | Hess | 131/10 R |
| 2,815,760 | 12/1957 | Schreus et al. | 131/262 A |
| 3,251,365 | 5/1966 | Keith et al. | 131/10.7 |

FOREIGN PATENT DOCUMENTS

| | | | |
|---|---|---|---|
| 2071369 | 10/1971 | France | 131/187 |

*Primary Examiner*—Stephen C. Pellegrino

[57] ABSTRACT

A smoking system is provided to filter tobacco smoke and remove harmful ingredients present in the smoke without adversely affecting the aroma and taste of the smoke and permitting easy draw of the smoke from a cigarette. A cylindrical chamber containing filtering means including a cation exchange material is formed to receive a cigarette at one end and to serve as a mouthpiece at the opposite end.

5 Claims, 4 Drawing Figures

SMOKING SYSTEM TO FILTER TOBACCO SMOKE

BACKGROUND OF THE INVENTION

The present invention relates to a smoking system and more particularly to a filter system for cigarettes and the like to remove certain harmful ingredients present in tobacco smoke.

In recent years, the public has shown an increasing concern about the harmful effects of cigarette smoking. Evidence established by medical research has linked cigarette smoking to cancer and various respiratory diseases. As a result, numerous cigarette filters have been designed in an attempt to provide an econmical and efficient means to filter out ingredients present in tobacco smoke believed to be detrimental to a smoker's health, particularly nicotine and tar. Most of these devices, however, do not provide an economical and efficient solution to this problem.

Accordingly, a primary object of the present invention is to provide a smoking sytem which is capable of removing ingredients present in tobacco smoke which have been shown to be harmful to a smoker's health.

Another object of our invention is to provide a smoking system to filter tobacco smoke and reduce the amount of nicotine and tars present in the tobacco smoke without adversely affecting the aroma and taste of the smoke.

Still a further object of our invention is to provide a smoking system to filter tobacco smoke and reduce the amount of nicotine and tars present in tobacco smoke by chemical reaction without adversely affecting the aroma and taste of the smoke.

Yet another object of our invention is to provide a smoking system to filter tobacco smoke which permits relatively free flow of smoke through the system so as not to hamper the smoker's ability to easily draw smoke without undue resistance from the filter.

A still further object of our invention is to provide a smoking system to filter tobacco smoke to reduce the amount of harmful ingredients present in the smoke and also cool the smoke as it passes through the filter.

Still another object of our invention is to provide a smoking system to filter tobacco smoke and reduce the amount of nicotine and tars present in tobacco smoke by means of a cation exchange material.

A further object of our invention is to provide a smoking system to filter tobacco smoke which is inexpensive, efficient and may be used a number of times before it is necessary to replace it.

In the preferred embodiment of our invention, cation exchange material is disposed between two filters in a cylindrical chamber. One end of the chamber is shaped to receive a cigarette and the opposite end is formed as a mouthpiece. Smoke from the cigarette passes through the filters and cation exchange material whereby the amount of nicotine, tars and other harmful ingredients present in tobacco smoke is substantially and meaningfully reduced before reaching the smoker.

DETAILED DESCRIPTION OF THE INVENTION

Figure 1:
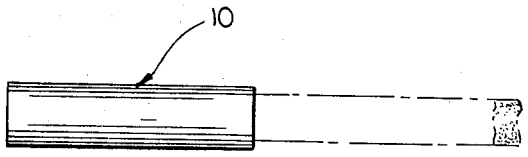
FIG. 1 is a side elevation view of a device according to the present invention.
Figure 2:
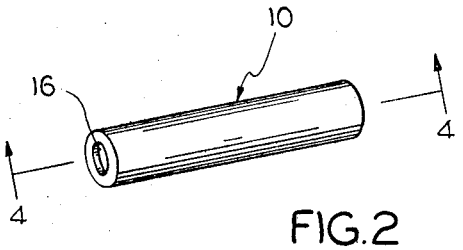
FIG. 2 is a perspective view of a device according to the present invention.
Figure 3:
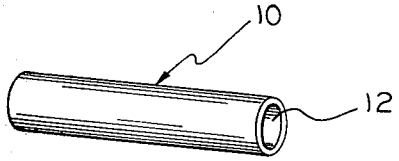
FIG. 3 is a perspective view of a device according to the present invention.
Figure 4:
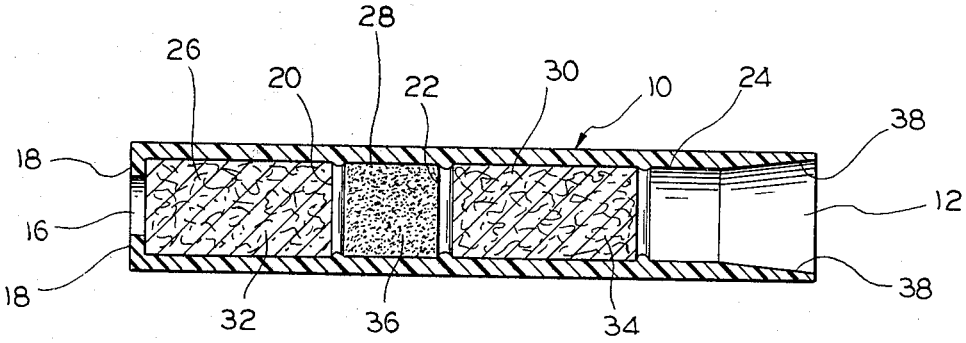
FIG. 4 is a cross-section side view of a device according to the present invention viewed along lines 4—4 of FIG. 2.

As shown in FIGS. 1, 2 and 3 a smoking system constructed in accordance with our invention comprises hollow cylindrical casing 10 made of high density polyethylene plastic or some other similar plastic material. A first aperture or opening 12 is formed at the forward end of casing 10 to receive an article of smoking material such as a cigarette and a second aperture or opening 16 formed at the opposite end of casing 10 serves as a mouthpiece through which a user draws the smoke.

Casing 10 includes an inwardly projecting shoulder 18 adjacent opening 16, whereby opening 16 is smaller than opening 12.

Shoulders 20, 22 and 24 project inwardly around the inner surface of casing 10, forming chambers 26, 28 and 30 within the casing, whereby the chambers communicate with each other. In the preferred embodiment of our invention, filter elements 32, 34, made of a material such as cellulose acetate by way of example, are placed in chambers 26 and 30 by inserting the filter elements through opening 12. Tapered edge 38 at opening 12 facilitates insertion of filter elements 32, 34. These elements are malleable and element 32 will easily fit through shoulders 20, 22 and 24 when inserted into chamber 26. Likewise element 34 will fit through shoulder 24. When in place, filter elements 32 and 34 are held in place in our smoke filtering system by shoulders 20, 22, and 24. Inwardly projecting shoulder 18 prevents filter element 32 from passing through opening 16.

A cation exchange material 36 in loosely compacted powder form is disposed between filter elements 32 and 34 in chamber 28. Cation exchange material 36, such as a polystyrene sulfonated resin, is processed to obtain a pH of between 5.5 to 6.5 and is employed in the hydrogen form to effectively reduce the amount of nicotine, other volatile nitrogen compounds, and tars present in tobacco smoke from passing to the smoker's lungs. Use of a cation exchange material to filter tobacco smoke for the purpose of removing nicotine is well known in the prior art and fully described in U.S. Pat. No. 2,754,829. Applicants have discovered that this material also removes tar in cigarette smoke.

Placement of cation exchange material 36 between filter elements 32, 34 prevents the material 36 from spilling out of casing 10, and from being inhaled by the smoker. In addition, filters 32, 34 prevent the cation exchange material from becoming compacted when the system is being used, insuring that the tobacco smoke will flow relatively freely through the cation exchange material 36.

To use our invention, a cigarette is placed in opening 12 and lighted. The cigarette may then be smoked by drawing the smoke through the filters 32, 34 and cation exchange material 36 and out through opening 16. The cation material 36 will prevent substantially all of the nicotine and tar in the smoke from being inhaled by the smoker.

It is understood that the foregoing disclosure is given by way of illustrative example only, rather than by way of limitation, and that without departing from the invention, the details may be varied within the scope of the appended claims.

We claim:

1. A smoking system to filter tobacco smoke comprising:

a hollow casing; a first aperture means disposed at one end of said casing and adapted to receive an article of smoking material, said first aperture means having a tapered edge; second aperture means disposed at the opposite end of said casing and forming a mouthpiece; a plurality of spaced apart shoulders projecting slightly inwardly from the inner surface of said hollow casing defining a plurality of chambers linearly aligned within said casing; cation exchange material disposed in one of said chambers; filter elements formed of cellulose acetate disposed in each of said chambers immediately adjacent to both sides of the chamber containing said cation exchange material and removably secured by said shoulders, whereby smoke generated by said article of smoking material passes through one of said filter elements, then through said cation exchange material, then through a second of said filter elements, and then through said second aperture, thereby reducing the amount of nicotine, tars, and other harmful ingredients from the smoke passing through said second aperture.

2. The smoking system of claim 1 wherein said cation exchange material is processed to obtain a pH of between 5.5 to 6.5.

3. The smoking system of claim 1 wherein said cation exchange material is a polystyrene sulfonated resin.

4. The smoking system of claim 1 wherein said cation exchange material is in a powder form.

5. The smoking system of claim 6 wherein said cation exchange material powder is relatively loosely compacted in its respective chamber.

* * * * *

UNITED STATES PATENT AND TRADEMARK OFFICE

CERTIFICATE OF CORRECTION

PATENT NO. : 4,226,250

DATED : October 7, 1980

INVENTOR(S) : Seymour Ehrenpreis and Barry Freedman

It is certified that error appears in the above–identified patent and that said Letters Patent are hereby corrected as shown below:

Column 4, Line 16, "6" should be changed to "4".

Signed and Sealed this

*Third* Day of *February 1981*

[SEAL]

*Attest:*

RENE D. TEGTMEYER

*Attesting Officer*

*Acting Commissioner of Patents and Trademarks*